US005816935A

United States Patent [19]

Se-Hyup

[11] Patent Number: 5,816,935

[45] Date of Patent: Oct. 6, 1998

[54] GOLF PUTTER

[76] Inventor: Lee Se-Hyup, No. 774-29, Jayang-dong, Kawangjin-gu, Seoul, Rep. of Korea

[21] Appl. No.: 847,201

[22] Filed: May 1, 1997

[51] Int. Cl.[6] ..... A63B 53/02

[52] U.S. Cl. ..... 473/313; 473/314

[58] Field of Search ..... 473/305, 313, 473/314, 315, 251, 219, 340

[56] References Cited

U.S. PATENT DOCUMENTS

| | | | |
|---|---|---|---|
| D. 202,504 | 10/1965 | Citro | 473/314 |
| D. 258,377 | 2/1981 | Nordness et al. | 473/314 |
| 1,705,250 | 3/1929 | Hincks | 473/313 |
| 3,448,981 | 6/1969 | Anweiler | 473/314 |
| 3,539,184 | 11/1970 | Koorland . | |
| 4,265,452 | 5/1981 | Vella | 473/313 |
| 4,650,191 | 3/1987 | Mills . | |
| 4,722,528 | 2/1988 | Tsao | 473/313 |
| 5,348,295 | 9/1994 | Phillips | 473/314 |
| 5,382,019 | 1/1995 | Sneed | 473/314 |

*Primary Examiner*—Sebastiano Passaniti
*Attorney, Agent, or Firm*—Harrison & Egbert

[57] ABSTRACT

A putter, having a connection bar straightly extending from the lower end of a straight shaft at an angle of 90°–110° prior to being downward to form a neck. In the putter, the head is connected to the neck with the face of the head being perpendicular to the connection bar. The length of the connection bar preferably ranges from 3 cm to 30 cm. The shaft extends in a plane perpendicular to the face of the head. The head is affixed directly and nonadjustably to an end of the neck opposite the connection bar. The shaft has a grip on a top portion thereof. The face of the head is positioned between 3 and 30 centimeters from the lower end of the shaft.

2 Claims, 4 Drawing Sheets

GOLF PUTTER

BACKGROUND OF THE INVENTION

1. Field of the Invention

The present invention relates, in general, to a putter used for gently hitting a golf ball into a hole on a putting green and, more particularly, to a putter suitable for effectively maintaining the course of a putted golf ball, preventing the golfer's tendency to lift his head, allowing the golfer's putting stance to be closer to the hole and thereby improving putting accuracy.

2. Description of the Prior Art

As well known to those skilled in the art, typical putters used for gently hitting a golf ball into a hole on a putting green have several types of heads: pingeye heads, acush heads, semicircular heads, etc. Most of the typical putters, regardless of their head configurations, are designed to individually have the face 7 of a putter head 6, positioned just below the lower end 3 of a straight shaft 2 as shown in FIG. 3. When a golfer with such a putter addresses the ball on a flat putting green, the putter face 7 is positioned to be perpendicular to a straight line extending from the ball to the hole on the putting green. Meanwhile, in the event of addressing the ball on a slope putting green, the putter face 7 is positioned to be perpendicular to a straight line extending from a golf ball to an objective point on the putting green. In either case, the golfer who addresses the ball hits the ball along the straight line.

When the putter face 7 is not perpendicular to either straight line while putting, the putted ball regrettably diverges from the hole. The typical putters thus diminish putting accuracy.

Another problem experienced by the typical putters is that they individually have a structural limit, causing a golfer in the addressed putting stance to unconsciously raise his head at the time of putting or glance at the hole before putting and thereby reducing the putting exactness.

SUMMARY OF THE INVENTION

Accordingly, the present invention has been made with the above problems occurring in the prior art in mind, and an object of the present invention is to provide a putter which effectively maintains the course of a putted golf ball, prevents a golfer from unconsciously looking at the hole or raising his head on a putting green and allows the putting stance to be closer to the hole, thus improving putting accuracy.

In order to accomplish the above object, the present invention provides a putter comprising a straight shaft having a grip on the top portion, a connection bar extending from the lower end of the straight shaft at an angle of 90°–110° and in turn bent downward to form a neck, and a head connected to the neck with the face of the head being perpendicular to the connection bar.

The length of the connection bar preferably ranges from 3 cm to 30 cm.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
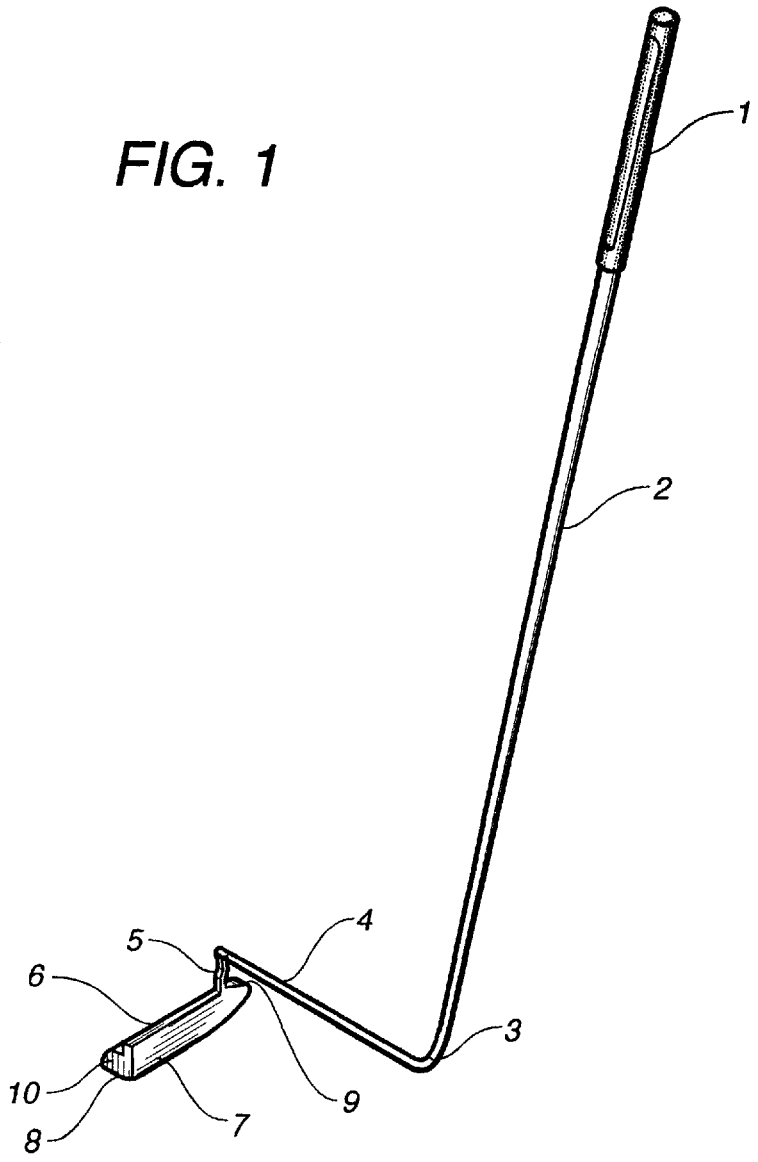
FIG. 1 is a perspective view showing the appearance of a putter in accordance with the preferred embodiment of the present invention.
Figure 2:
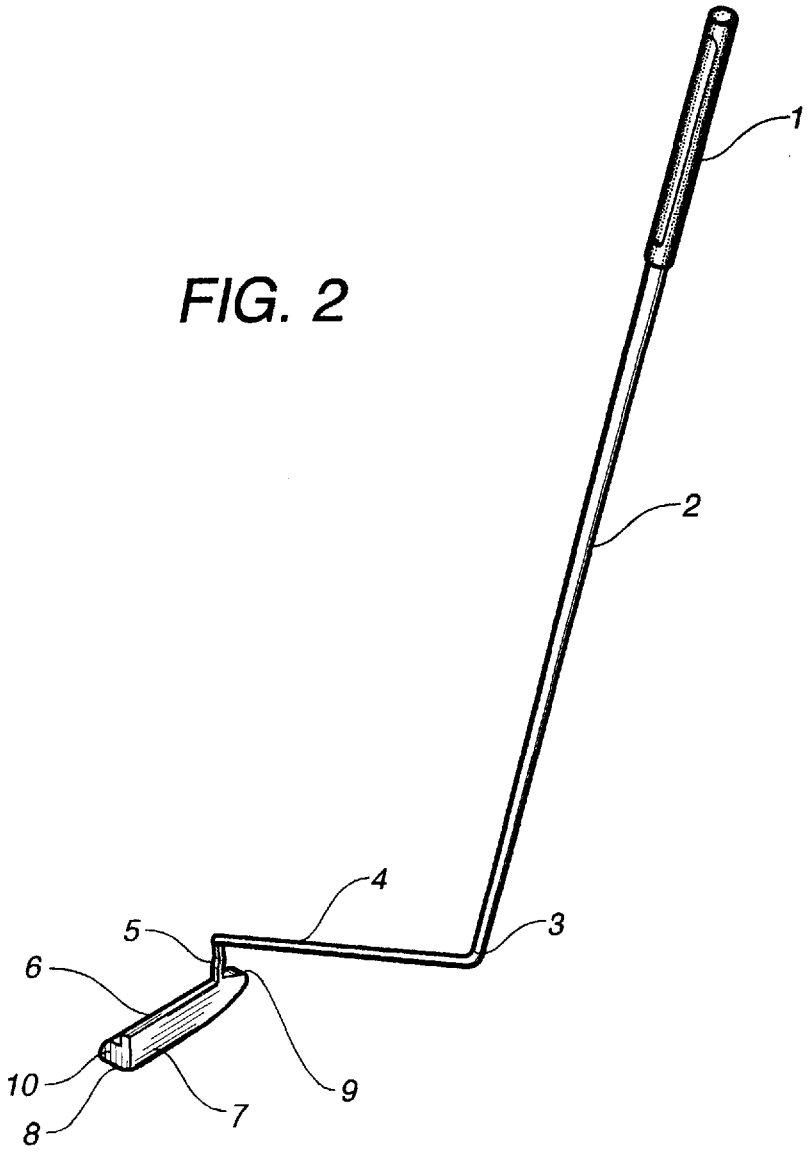
FIG. 2 is a perspective view showing the appearance of a putter in accordance with another embodiment of the present invention.
Figure 3:
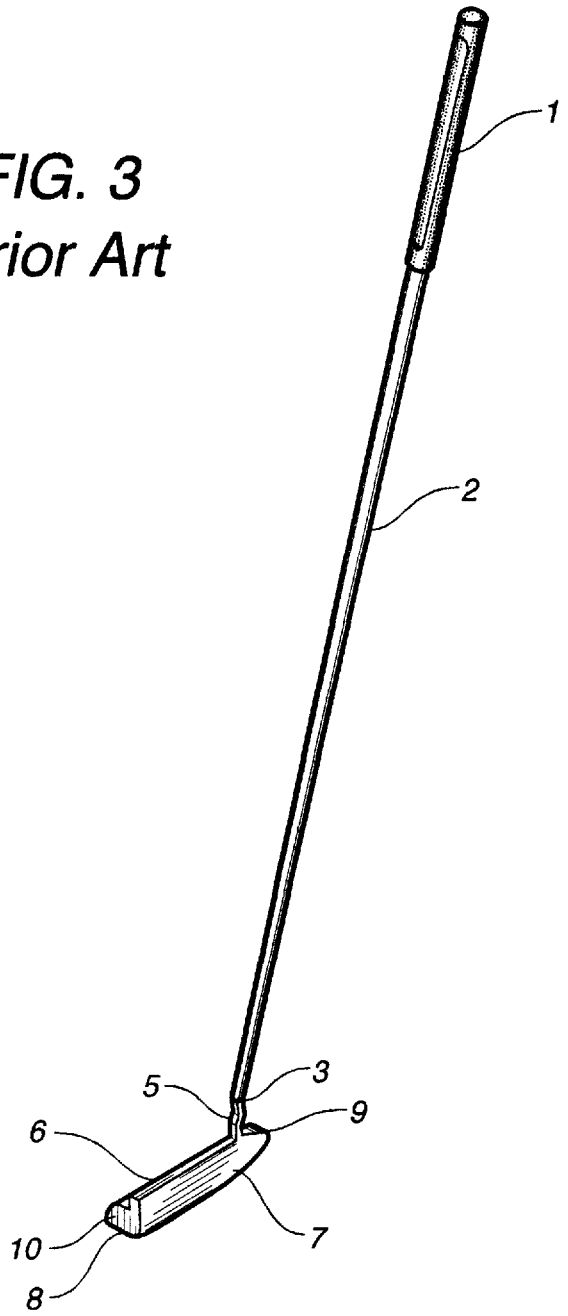
FIG. 3 Prior Art
FIG. 3 is a perspective view showing the appearance of a typical putter.

The putter according to the invention is designed to overcome the problems experienced by the typical putters and improves putting accuracy. FIGS. 1 and 2 are perspective views showing the appearances of putters in accordance with the preferred and alternative embodiments of the present invention, respectively. As shown in FIGS. 1 and 2, the putter of this invention has a connection bar 4, which extends straight from the lower end 3 of a straight shaft 2 at an angle of 90°–110° and in turn is bent downward to form a neck 5. The top end of the straight shaft 2 has a grip 1. A head 6 is connected to the lower end of the neck 5, with the head face 7 being perpendicular to the connection bar 3.

In the drawings, the reference numerals 8, 9 and 10 denote a sole, a heel and a toe of the putter head 6, respectively.

Fundamentally, the advantage of the putter according to this invention resides in that the putter head 6 is connected to the shaft 2 through both the connection bar 4, extending from the lower end 3 of the shaft 2 at an angle of 90°–110°, and the neck 5 formed by bending the end of the connection bar 4 downward.

The connection bar 4 according to the primary embodiment extends from the lower end 3 of the shaft 2 at an angle of 90° as shown in FIG. 1, while the connection bar 4 according to the second embodiment extends from the lower end 3 of the shaft 2 at an angle of 110° as shown in FIG. 2. The putters of FIGS. 1 and 2 in the addressed putting stance are shown in FIGS. 4A and 4B, respectively.

Figure 4A:
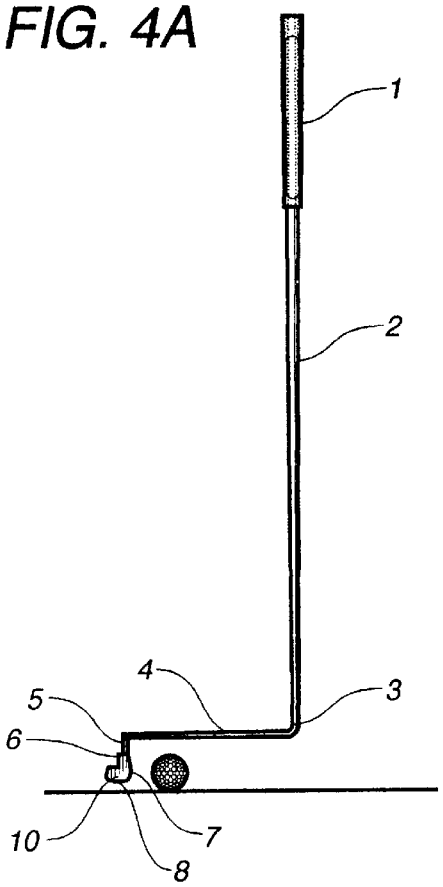
FIG. 4A is a front view of the putter of FIG. 1 in the addressed putting stance.
Figure 4B:
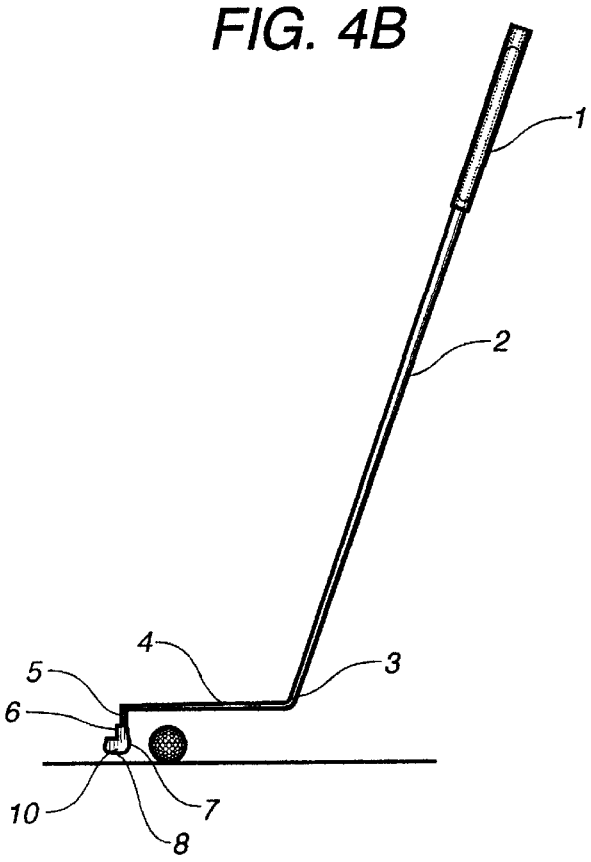
FIG. 4B is a front view of the putter of FIG. 2 in the addressed putting stance.

In the addressed putting stance, the connection bar 4 of either putter of this invention is positioned parallel to the green, with the head face 7 being perpendicular to the connection bar 4 as shown in FIG. 4A or 4B. In the normal putting stance, the shaft 2 according to the primary embodiment is perpendicular to the green, while the shaft 2 according to the second embodiment is inclined to the green.

In a putter of this invention, the angle between the shaft 2 and the connection bar 4 has to range from 90° to 110° for the following reasons.

The connection bar 4 of a putter in the normal putting stance has to be parallel to the green, with the head face 7 being perpendicular to the green. When the angle between the shaft 2 and the connection bar 4 is less than 90°, the following problem may occur.

That is, a golfer with such a putter has to move the putting stance to the left in FIG. 4A in order to make both the connection bar 4 parallel to the green and the head face 7 perpendicular to the green. In the above putting stance, the lower end 3 of the shaft 2 may be close to or brought into contact with the green while putting so that it is almost impossible to effectively putt.

Therefore, the minimum angle between the shaft 2 and the connection bar 4 has to be at least 90°.

Meanwhile, when the angle between the shaft 2 and the connection bar 4 is larger than 90°, the shaft 90 in the addressed putting stance is inclined to the right as shown in FIG. 4B. When the angle between the shaft 2 and the connection bar 4 is larger than 110°, a golfer necessarily hits the ball while drawing the ball in so that the golfer almost fails to effectively putt. In addition, it is almost impossible to align the connection bar 4 with the straight line extending from the ball to the hole while putting such that putting accuracy is reduced. Therefore, the maximum angle between the shaft 2 and the connection bar 4 has to be 110°.

In order to effectively maintain the course of a putted golf ball and improve the putting accuracy, the connection bar 4 has an appropriate length. When the putter of this invention has a long connection bar 4, the putter somewhat effectively maintains the course of a putted golf ball. The putter with such a long connection bar 4 also allows the position of both the ball and the putter head 6 to lean to the right of a golfer in the addressed putting stance, thus preventing the golfer from unconsciously looking at the hole or raising his head on the putting green. However, when the putter has an exceedingly long connection bar 4, the center of gravity of the putter moves to the right so that such a putter is inconvenient to a golfer while putting, thus forcing the golfer to hit the ball while drawing the ball in and thereby reducing the putting accuracy.

The appropriate maximum length of the connection bar 4, suitable for maintaining the course of a putted golf ball, preventing the golfer's tendency to lift his head and smoothly hitting the ball, is limited to about 30 cm.

While putting with the putter of this invention, a golfer hits a ball with the connection bar 4 being aligned with either a straight line extending from a ball to the hole on a flat putting green or a straight line extending from a ball to an objective point on a slope putting green, thus improving the putting accuracy. In addition, the putter of this invention also allows the position of both the ball and the putter head to lean to the right of a golfer in the addressed putting stance so that the putter effectively prevents the golfer from unconsciously looking at the hole or raising his head on the putting green, thereby greatly improving putting accuracy.

Different from a typical putter with the head face being perpendicular to a straight line extending from the ball to the hole while putting, the putter of this invention allows a golfer to smoothly putt with both the head face being perpendicular to such a straight line and the connection bar being aligned with the straight line, thus more improving the putting exactness.

The putter of this invention also allows the golfer's putting stance to be closer to the hole in the event of a short distance putting, thereby more improving the exactness while putting.

The following examples are merely intended to illustrate the present invention in further detail and should by no means be considered to limitative of the scope of the invention.

EXAMPLE 1

Three 8-handicappers A, B and C individually and repeatedly putted 100 balls on a flat putting green at each of four putting distances: 1 m, 2 m, 4 m and 8 m and with each of three putters: a typical pineye putter, the 1st putter according to this invention (the angle between the shaft and the connection bar: 90°, the length of the connection bar: 10 cm) and the 2nd putter according to this invention (the angle between the shaft and the connection bar: 90°, the length of the connection bar: 20 cm). The ratios (%) of putting success are given Tables 1 and 2.

TABLE 1 the ratio of putting success

| ratio of putting success (putting distance) | | ratio(%) | ratio(%) | ratio(%) | ratio(%) |
|---|---|---|---|---|---|
| putters | golfers | (1 m) | (2 m) | (4 m) | (8 m) |
| typical | A | 78 | 54 | 28 | 11 |
| putter | B | 76 | 51 | 21 | 5 |
| pingeye | C | 81 | 44 | 18 | 9 |
| 1st putter | A | 89 | 64 | 31 | 13 |
| | B | 85 | 65 | 23 | 7 |
| | C | 88 | 53 | 21 | 10 |
| 2nd putter | A | 91 | 67 | 33 | 12 |
| | B | 89 | 68 | 26 | 10 |
| | C | 92 | 52 | 22 | 12 |

TABLE 2 the average ratio of putting success

| average ratio of putting success (putting distance) putters | ratio(%) (1 m) | ratio(%) (2 m) | ratio(%) (4 m) | ratio(%) (8 m) |
|---|---|---|---|---|
| typical putter (pineye) | 78 | 50 | 22 | 8 |
| 1st putter | 87 | 61 | 25 | 10 |
| 2nd putter | 91 | 62 | 27 | 11 |

From the Tables 1 and 2, it is apparent that the putting effect of the putters according to this invention is remarkably higher than the typical pineye putter.

EXAMPLE 2

The above three golfers A, B and C putted in the same manner as described for Example 1, substituting the 3rd putter according to this invention (the angle between the shaft and the connection bar: 90°, the length of the connection bar: 3 cm) and the 4th putter according to this invention (the angle between the shaft and the connection bar: 90°, the length of the connection bar: 30 cm) for the 1st and 2nd putters respectively. In accordance with Example 2, the average ratio of putting success of the 3rd putter increases by 1.5% in comparison with the typical pineye putter. Meanwhile, the average ratio of putting success of the 4th putter is almost equal to that of the typical pineye putter.

In a putter of this invention with a connection bar having a length longer than 30 cm, the ratio of putting success is reduced.

As described above, the present invention provides a putter, which has a connection bar straightly extending from the lower end of a straight shaft at an angle of 90°–110° prior to being downward to form a neck. The putter of this invention effectively maintains the course of a putted golf balls prevents a golfer from unconsciously looking at the hole or raising his head on a putting green and allows the putting stance to be closer to the hole, thus improving putting accuracy.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A putter comprising:

a straight shaft having a grip on a top portion thereof;

a connection bar extending from a lower end of said straight shaft at an angle of between 90°–110°, said connection bar being bent downward at an end opposite said lower end of said straight shaft to form a neck, said neck extending entirely perpendicularly downwardly from said connection bar; and a head nonadjustably connected directly to an end of said neck opposite said connection bar, said head having a face being perpendicular to said connection bar, said face being positioned between 3 and 30 centimeters from said lower end of said straight shaft, said straight shaft and said connection bar extending in a plane perpendicular to said face.

2. The putter according to claim 1, wherein said connection bar has a length ranging from 3 centimeters to 30 centimeters.

* * * * *